US011598045B2

(12) United States Patent
Chae et al.

(10) Patent No.: US 11,598,045 B2
(45) Date of Patent: Mar. 7, 2023

(54) CLOTHING MANAGEMENT APPARATUS AND METHOD FOR CONTROLLING THEREOF

(71) Applicant: Samsung Electronics Co., Ltd, Suwon-si (KR)

(72) Inventors: Gyeongryeol Chae, Suwon-si (KR); Jinyoung Choi, Suwon-si (KR); Judai Kim, Suwon-si (KR); Jaeryong Park, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 209 days.

(21) Appl. No.: 16/569,397

(22) Filed: Sep. 12, 2019

(65) Prior Publication Data

US 2020/0080251 A1 Mar. 12, 2020

(30) Foreign Application Priority Data

Sep. 12, 2018 (KR) ..... 10-2018-0109267

(51) Int. Cl.

| | |
|---|---|
| ***D06F 58/30*** | (2020.01) |
| ***D06F 58/10*** | (2006.01) |
| ***D06F 73/02*** | (2006.01) |
| *D06F 58/50* | (2020.01) |

(52) U.S. Cl.

CPC ..... *D06F 58/30* (2020.02); *D06F 58/10* (2013.01); *D06F 73/02* (2013.01); *D06F 58/50* (2020.02)

(58) Field of Classification Search

CPC ..... D06F 58/10; D06F 58/30; D06F 58/32; D06F 58/50; D06F 73/02; D06F 2105/40; D06F 2105/52; D06F 2105/54; D06F 2105/58; D06F 39/008; D06F 2103/62

See application file for complete search history.

(56) References Cited

U.S. PATENT DOCUMENTS

| | | | |
|---|---|---|---|
| 7,614,106 | B2 | 11/2009 | Oh et al. |
| 8,037,565 | B2 | 10/2011 | Herkle et al. |
| 8,505,340 | B2 | 8/2013 | Kim et al. |
| 9,303,349 | B2 | 4/2016 | Moon et al. |

(Continued)

FOREIGN PATENT DOCUMENTS

| | | | |
|---|---|---|---|
| JP | 2017113159 | A | 6/2017 |
| KR | 10-0658842 | B1 | 12/2006 |

(Continued)

OTHER PUBLICATIONS

International Search Report dated Dec. 20, 2019 in connection with International Patent Application No. PCT/KR2019/011747, 3 pages.

(Continued)

*Primary Examiner* — Marc Lorenzi

(57) ABSTRACT

Provided is a clothing management apparatus. The clothing management apparatus includes a steam generator configured to generate steam, a steam discharging member configured to receive steam generated by the steam generator through a hose and discharge the received steam to clothing, a temperature sensor configured to sense a temperature in the clothing management apparatus, and a processor configured to identify a connection state of the hose based on the temperature sensed by the temperature sensor.

1 Claim, 6 Drawing Sheets

(56) References Cited

U.S. PATENT DOCUMENTS

| | | | | |
|---|---|---|---|---|
| 10,145,059 | B2 | 12/2018 | Kim | |
| 2002/0032491 | A1* | 3/2002 | Imamura | D06F 34/28 700/79 |
| 2006/0191077 | A1* | 8/2006 | Oh | D06F 39/008 8/158 |
| 2008/0141734 | A1* | 6/2008 | Son | D06F 58/203 68/5 C |
| 2008/0209757 | A1* | 9/2008 | Park | D06F 33/65 34/389 |
| 2008/0256720 | A1* | 10/2008 | Park | D06F 33/65 8/149.3 |
| 2008/0271754 | A1* | 11/2008 | Park | D06F 33/47 8/158 |
| 2009/0038084 | A1* | 2/2009 | Lee | D06F 39/008 8/149.1 |
| 2009/0083990 | A1 | 4/2009 | Bae et al. | |

FOREIGN PATENT DOCUMENTS

| | | | |
|---|---|---|---|
| KR | 100763386 | B1 | 10/2007 |
| KR | 10-2009-0051367 | A | 5/2009 |
| KR | 10-2010-0094137 | A | 8/2010 |
| KR | 10-2013-0053216 | A | 5/2013 |
| KR | 101525569 | B1 | 6/2015 |
| KR | 101596501 | B1 | 2/2016 |
| KR | 10-2017-0137503 | A | 12/2017 |

OTHER PUBLICATIONS

Written Opinion of the International Searching Authority dated Dec. 20, 2019 in connection with International Patent Application No. PCT/KR2019/011747, 5 pages.

* cited by examiner

CLOTHING MANAGEMENT APPARATUS AND METHOD FOR CONTROLLING THEREOF

CROSS-REFERENCE TO RELATED APPLICATIONS

This application is based on and claims priority under 35 U.S.C. § 119 to Korean Patent Application No. 10-2018-0109267 filed on Sep. 12, 2018 in the Korean Intellectual Property Office, the disclosure of which is incorporated by reference herein in its entirety.

BACKGROUND

1. Field

The disclosure relates to a clothing management apparatus and a controlling method thereof and, more particularly, to a clothing management apparatus for identifying a connection state of a steam hose on the basis of temperature information of sensing the inside of the clothing management apparatus and a controlling method thereof.

2. Description of Related Art

Recently, separately from a washing machine, a clothing management apparatus for conveniently handling or managing clothing and having functions such as removing wrinkles of clothing or removing dust or odor through steam is used.

In the related art, there has been no way to identify whether a steam hose which connects a steam generator for generating steam and a steam discharging member for discharging the generated steam to clothing is disconnected.

SUMMARY

Embodiments of the disclosure address the above disadvantages and other disadvantages not described above. Also, the disclosure is not required to address the disadvantages described above, and an embodiment may not address any of the problems described above.

The objective of the disclosure is to provide a clothing management apparatus to identify a connection state of a steam hose on the basis of temperature information of sensing the inside of the clothing management apparatus and a controlling method thereof.

The clothing management apparatus according to an embodiment may include a steam generator configured to generate steam, a steam discharging member configured to receive steam generated by the steam generator through a hose and discharge the received steam to clothing, a temperature sensor configured to sense temperature inside the clothing management apparatus, and a processor configured to identify a connection state of the hose on the basis of temperature sensed by the temperature sensor.

A controlling method of a clothing management apparatus according to an embodiment may include generating steam, discharging the generated steam to clothing through a hose, sensing temperature inside the clothing management apparatus, and identifying a connection state of the hose on the basis of the sensed temperature.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or, the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

Figure 1:
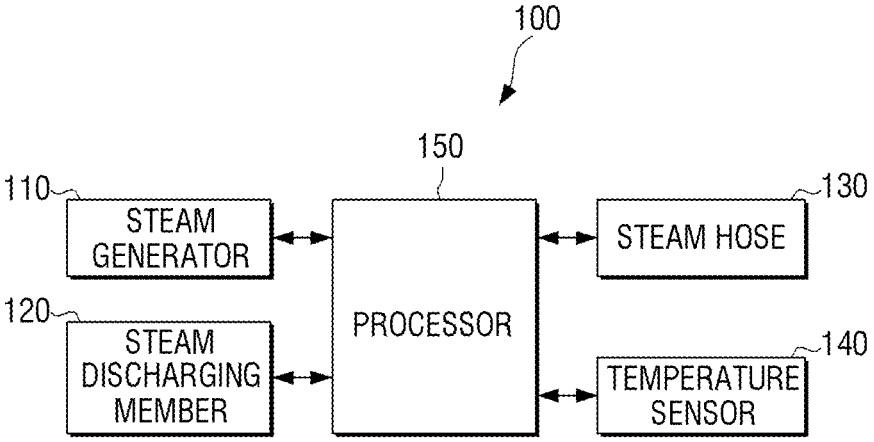
FIG. 1 illustrates a block diagram to describe a simple configuration of a clothing management apparatus according to an embodiment.

FIGS. 1 through 6, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

After terms used in the specification are briefly described, the disclosure will be described in detail.

General terms that are currently widely used were selected as terms used in exemplary embodiments of the disclosure in consideration of functions in the disclosure, but may be changed depending on the intention of those skilled in the art or a judicial precedent, the emergence of a new technique, and the like. In addition, in a specific case, terms arbitrarily chosen by an applicant may exist. In this case, the meaning of such terms will be mentioned in detail in a corresponding description portion of the disclosure. Therefore, the terms used in exemplary embodiments of the disclosure should be defined on the basis of the meaning of the terms and the contents throughout the disclosure rather than simple names of the terms.

Since the disclosure may be variously modified and have several embodiments, specific embodiments of the disclosure will be illustrated in the drawings and be described in detail in the detailed description. However, it is to be understood that the disclosure is not limited to specific embodiments, but includes all modifications, equivalents, and substitutions without departing from the scope and spirit of the disclosure. When it is decided that a detailed description for the known art related to the disclosure may obscure the gist of the disclosure, the detailed description will be omitted.

Terms 'first', 'second', and the like, may be used to describe various components, but the components are not to be construed as being limited by the terms. The terms are used only to distinguish one component from another component.

Singular forms are intended to include plural forms unless the context clearly indicates otherwise. It will be further understood that terms "include" or "formed of" used in the specification specify the presence of features, numerals, steps, operations, components, parts, or combinations thereof mentioned in the specification, but do not preclude the presence or addition of one or more other features, numerals, steps, operations, components, parts, or combinations thereof.

Hereinafter, embodiments of the disclosure will be described in detail with reference to the accompanying drawings so that those skilled in the art to which the disclosure pertains may easily practice the disclosure. However, the disclosure may be implemented in various different forms and is not limited to embodiments described herein. In addition, in the drawings, portions unrelated to the description will be omitted to obviously describe the disclosure.

The disclosure will be described in greater detail with reference to the drawings.

FIG. 1 illustrates a block diagram to describe a simple configuration of a clothing management apparatus according to an embodiment.

Referring to FIG. 1, a clothing management apparatus 100 includes a steam generator 110, a steam discharging member 120, a steam hose 130, a temperature sensor 140, and a processor 150.

The steam generator 110 generates steam by heating stored water. To be specific, the steam generator 110 may include a water tank for storing water and include a heater to generate steam by heating water supplied from the water tank. The steam generator 110 may provide the generated steam to the steam discharging member 120 through the steam hose 130.

The steam discharging member 120 discharges steam to an accommodating space within the clothing management apparatus 100. To be specific, the steam discharging member 120 may change fabric construction of clothing to a flexible state by discharging high temperature steam provided from the steam generator 110 to the accommodating space through the steam hose 130.

The steam hose 130 moves the steam generated from the steam generator 110 to the steam discharging member 120. To be specific, the steam hose 130 may be connected to the steam generator 110 and the steam discharging member 120, and may move the steam generated by the steam generator 110 to the steam discharging member 120.

The steam hose 130 may be damaged due to omission of assembly with the steam generator 110 or the steam discharging member 120 in the manufacturing process of the clothing management apparatus 100, or due to a long-time use. In this case, the steam generated by the steam generator 110 may not be moved to the steam discharging member 120 and may be leaked.

In this disclosure, it has been described that the steam generated from the steam generator 110 is delivered to the steam discharging member 120 through the steam hose 130, but in implementation, the hose may be implemented as various configurations such as a pipe, flow path, or the like.

The temperature sensor 140 senses temperature in the clothing management apparatus 100. To be specific, the temperature sensor 140 may sense a change in temperature of air within the clothing management apparatus 100 due to steam flown into the accommodating space of the clothing management apparatus 100, compressed air, clothing disposed in the accommodating space, or the like. There may be a plurality of the temperature sensors 140.

A specific description regarding a place for disposition of the steam generator 110, the steam discharging member 120, and the temperature sensor 140 will be described below with reference to FIG. 3.

The processor 150 performs control of each configuration in the clothing management apparatus 100. To be specific, the processor 150 may control an operation of the configuration related to a specific function among a plurality of functions of the clothing management apparatus 100. For example, when performing a steam function is necessary, the processor 150 may control an operation of the steam generator 110 and the steam discharging member 120.

The processor 150 may confirm a connection state of the steam hose 130 based on temperature sensed by the temperature sensor 140.

To be specific, when the steam hose 130 is disconnected, even if the steam generator 110 generates steam, stem may not be normally discharged into the accommodating space through the steam discharging member 120. The steam generated herein may be leaked to an internal circuit or electrical components of the clothing management apparatus 100, instead of the accommodating space, or to the outside of the clothing management apparatus 100, thereby increasing humidity of indoor space where the clothing management apparatus 100 is disposed.

That is, when the steam hose 130 is disconnected, the generated steam may not be discharged into the accommodating space through the steam discharging member 120, and thus, the range of temperature change inside the clothing management apparatus 100 may be smaller than the range of temperature change sensed when the clothing management apparatus 100 operates normally.

For example, when the steam hose 130 is disconnected, the range of the temperature change inside the clothing management apparatus 100 may be three degrees or below, and when the steam hose 130 is normally installed, the range of temperature change inside the clothing management apparatus 100 may be nine degrees or more.

Accordingly, the processor 150 may identify the connection state of the steam hose 130 according to whether the range of temperature change sensed by the temperature sensor 140 after the steam is discharged from the steam discharging member 120 satisfies a predetermined range.

Specifically, the processor 150 may calculate the difference between the highest temperature and the lowest temperature of the temperature information detected by the temperature sensor 140 after discharging steam from the steam discharging member 120, and identify whether the calculated temperature difference is beyond the predetermined range.

Here, the predetermined range is the average changing variation of the temperature sensed when the steam hose 130 is installed normally, and the range may be determined according to a result of a repetitive experiment. For example, the predetermined range may be three degrees or higher.

If the calculated temperature different satisfy a predetermined range, the processor 150 may identify that the steam hose 130 is normally installed. In contrast, when the calculated temperature difference is out of the predetermined range, the processor 150 may identify that the steam hose 130 is disconnected.

After the steam is discharged from the steam discharging member 120, the processor 150 may identify a connection state of the steam hose 130 using only the temperature information sensed during a predetermined time.

When steam is discharged from the steam generator 110 and temperature sensing is performed for a considerable time, if the steam hose 130 is disconnected, the generated steam may be leaked to the internal circuit or electrical components inside the clothing management apparatus 100, possibly causing a damage to the clothing management apparatus 100.

Therefore, when the steam hose 130 is disconnected, whether the steam hose 130 is disconnected may be determined before the required time is reached in consideration of time normally taken for the steam to leak into the internal circuit or electrical components, and if it is determined that the steam hose 130 is disconnected, it is possible to prevent the damage to the clothing management apparatus 100 by taking a follow-up measure.

Accordingly, the processor 150 may identify the connection state of the steam hose 130 by using only the temperature information sensed during the predetermined time, that is, the time which is generally required until the steam is leaked into the internal circuit or electrical components, after the steam is discharged by the steam discharging member 120.

When it is identified that the steam hose 130 is disconnected, the processor 150 may control so that the steam generator 110 stops a steam generation operation.

If it is identified that the steam hose 130 is disconnected, the processor 150 may perform a clothing management operation with a course different than the steam generation operation.

Specifically, the clothing management apparatus 100 may perform a plurality of functions such as heating/steaming/drying/dust removing. The processor 150 may control so that the clothing management operation is performed by combining a plurality of functions. Accordingly, if the steam hose 130 is confirmed to be disconnected, the processor 150 may control so that heating, drying, dust removing functions, or the like, other than the steam function, are performed.

A specific description regarding a plurality of functions of the clothing management apparatus 100 such as heating/steaming/drying/dust removing, or the like, will be described below with reference to FIG. 3.

It has been described a simple configuration of the clothing management apparatus, but in implementation, various configurations may be added. This will be described below with reference to FIG. 2.

Figure 2:
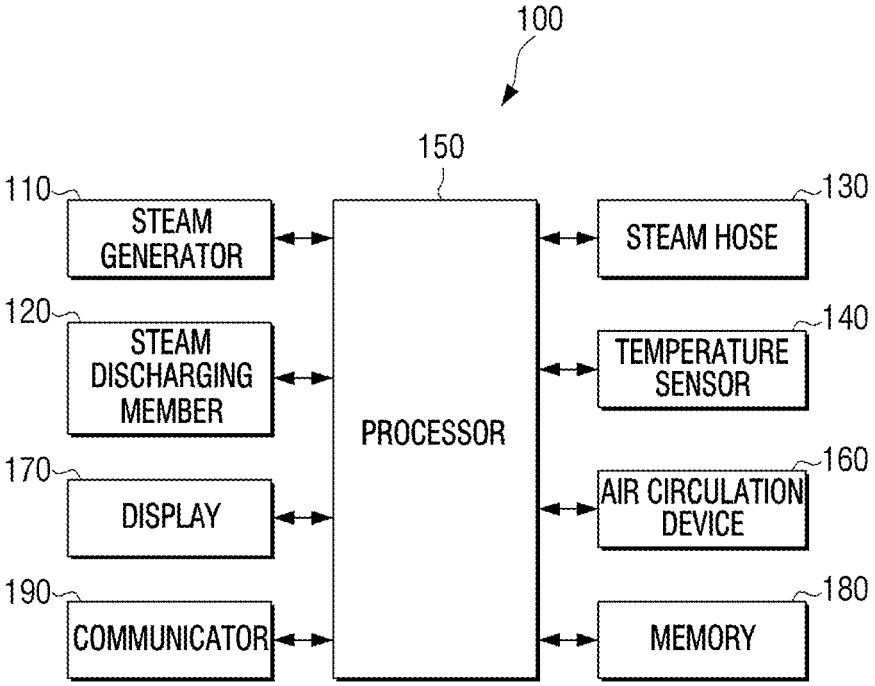
FIG. 2 illustrates a block diagram illustrating a specific configuration of a clothing management apparatus according to an embodiment.

FIG. 2 illustrates a block diagram illustrating a specific configuration of a clothing management apparatus according to an embodiment.

Referring to FIG. 2, the clothing management apparatus 100 may include the steam generator 110, the steam discharging member 120, the temperature sensor 140, the processor 150, an air circulation device 160, a display 170, a memory 180, and a communicator 190.

The steam generator 110, the steam discharging member 120, the steam hose 130, the temperature sensor 140, and the processor 150 perform the same function as FIG. 1 and thus, the overlapped description will be omitted.

The air circulation device 160 may generate high-temperature air by compressing the air in the accommodating space of the clothing management apparatus 100. In addition, the air circulation device 160 may dry the clothing by discharging the compressed high-temperature air back to the accommodating space, and the circulation of air may be repeated periodically.

The air circulation device 160 may include a compressor for compressing air, a fan for moving the air, and a refrigerant for providing heat to the air. In addition, the temperature sensor 140 may be mounted to the front/rear end of the air circulation device 160 to detect the temperature of the air entering or discharging from the air circulation device 160.

The display 170 may display various information provided by the clothing management apparatus 100. To be specific, the display 170 may display a user interface window for receiving selection of various functions provided by the clothing management apparatus 100.

The display 170 may be a monitor such as a liquid crystal display (LCD), a cathode-ray tube (CRT), and organic light emitting diodes (OLED), and may be implemented as a touch screen that may perform a function of receiving a selection of a function by a user and a function of receiving a control command for the function simultaneously.

When it is identified that the steam hose 130 is disconnected, the display 170 may display error information to a user. To be specific, the display 170 may display an image for a position of the steam hose 130 and follow-up action of a user.

The memory 180 stores a variety of data for the operation of the overall clothing management apparatus 100, such as a program for processing or controlling of the processor 150. To be specific, the memory 180 may store a plurality of application programs driven in the clothing management apparatus 100, data and instructions for operating the clothing management apparatus 100.

The memory 180 may be accessed by the processor 150 and reading/recording/modifying/updating, or the like of data may be performed by the processor 150. The memory 180 may be implemented not only as a storage medium inside the clothing management apparatus 100 but also an external storage medium, a removable disk including a universal serial bus (USB) memory, a web server through network, or the like.

The memory 180 may store information of disconnection of the steam hose 130. To be specific, when the steam hose 130 is disconnected, the processor 150 may store the error information in the memory 180. The stored error information may be transmitted to an external device through the communicator 190.

The communicator 190 is connected to an external device (not shown), and may transmit and receive various data from the external device. To be specific, the communicator 190 may be connected to an external device not only through a local area network (LAN) and the Internet but also through a universal serial bus (USB) port or a wireless communication (for example, WiFi 802.11a/b/g/n, near field communication (NFC), Bluetooth) port is also possible. Here, the external device may be a PC, a notebook, a smartphone, a server, or the like.

When it is determined that the steam hose 130 is disconnected, the communicator 190 may provide error information to a management server corresponding to a service center.

As described above, the clothing management apparatus according to an embodiment may grasp whether a hose is disconnected by using the temperature sensor even without an additional sensor for sensing a disconnection state of the steam hose.

Therefore, by identifying whether steam has leaked due to disconnection of the steam hose, damage to the clothing management apparatus may be prevented, and as an additional sensor is not required, there is a cost saving effect.

Figure 3:
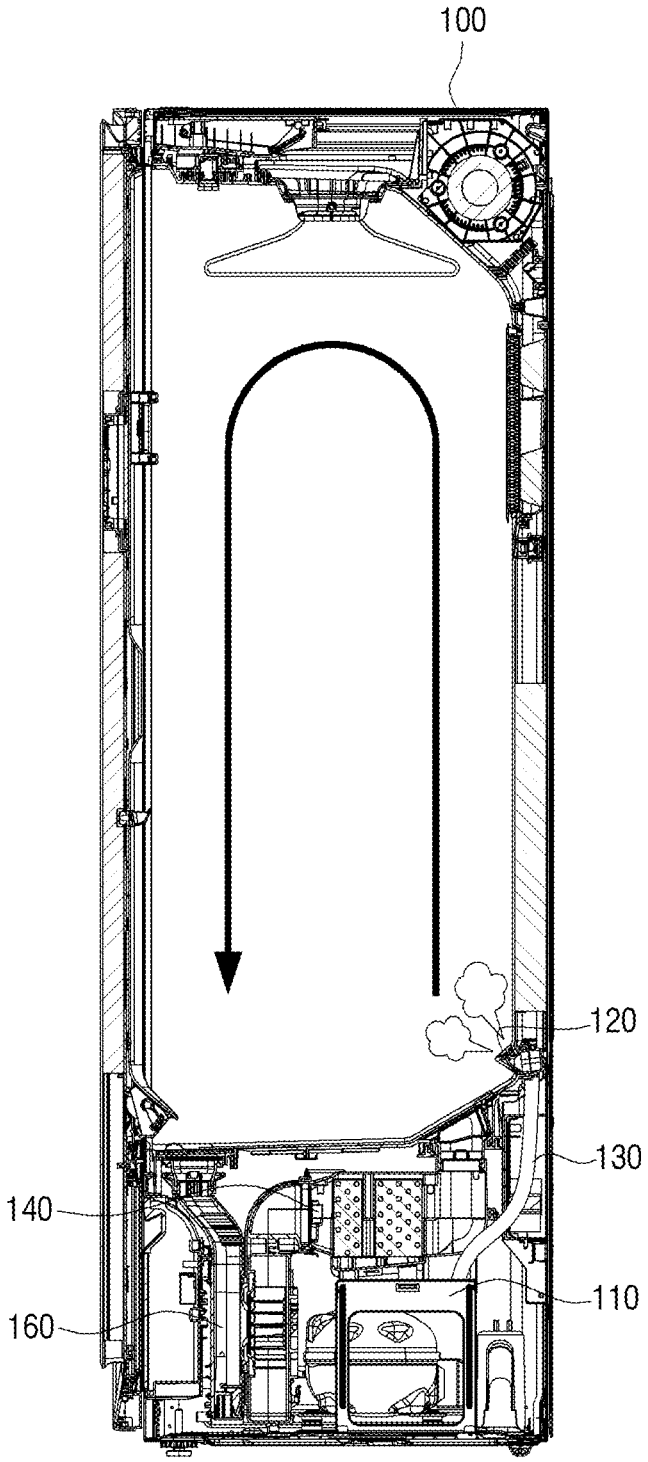
FIG. 3 illustrates a front view of a clothing management apparatus according to an embodiment.

FIG. 3 illustrates a front view of a clothing management apparatus according to an embodiment.

Referring to FIG. 3, a specific disposition place of the steam generator 110, the steam discharging member 120, the steam hose 130, the temperature sensor 140, and the air circulation device 160 may be identified.

At an upper portion of the accommodating space within the clothing management apparatus 100, a clothing support device in a hanger shape may be disposed. A user may use the clothing management apparatus 100 while clothing is supported by and fixed to the clothing support device.

The steam generator 110 may be disposed at a lower portion of the accommodating space within the clothing management apparatus 100. In addition, the steam generator 110 and the steam discharging member 120 may be connected by the steam hose 130.

The steam discharging member 120 may receive the steam generated by the steam generator 110 through the steam hose 130, and discharge the steam toward clothing disposed in the accommodating space within the clothing management apparatus 100.

The steam discharging member 120 may be disposed at one side of the accommodating space within the clothing management apparatus 100 to be movable upward and downward, and spray steam evenly while moving upward and downward. A location of the steam discharging member 120 is not limited to the above example.

When the steam hose 130 is disconnected, steam generated in the steam generator 110 may be leaked to the air circulation device 160, the internal circuit or electrical components located at the lower end of the accommodating space or the outside of the clothing management apparatus 100. The leaked steam may cause damage to the clothing management apparatus 100.

The temperature sensor 140 may be disposed on one side of the accommodation space in the clothing management apparatus 100 to detect a change in temperature of the air in the accommodating space. In addition, the temperature sensor 140 may be disposed at the front/rear ends of the air circulation device 160 to detect a change in temperature of air introduced or discharged into the air circulation device 160.

The installation location of the temperature sensor 140 is not limited to the above example, and may be disposed in any place capable of sensing temperature in the clothing management apparatus 100.

The air circulation device 160 may be disposed in the lower portion of the accommodating space in the clothing management apparatus 100. The air circulation device 160 may include an inlet in through which air is introduced into the accommodating space and an outlet through which air is discharged to the accommodating space. Referring to FIG. 3, the air circulation device 160 may circulate air in the direction of the arrow through the inlet and the outlet.

The clothing management apparatus 100 may, while the clothing is supported and fixed by the clothing support device, perform predetermined functions for managing clothing, using the steam generator 110, the steam discharging member 120, and the air circulation device 160.

For example, the clothing management apparatus 100 may perform a clothing management operation in the order of heating/steaming/drying/dust removing using the steam generator 110, the steam discharging member 120, and the air circulation device 160.

Here, the heating function is a function to introduce the high-temperature air into the accommodating by using the air circulation device 160 disposed in the lower portion of the accommodating space, so that the introduced high-temperature air changes the fabric structure of the clothing into a flexible state. As the fabric construction of the clothing changes to a flexible state, the effect of the subsequent steaming function may be increased.

In addition, the steaming function is a function of spraying high-temperature steam to the clothing using the steam generator 110 and the steam discharging member 120, and is a function that may apply pressure to the front or rear surfaces of the clothing. By this function, clothing may be compressed. In this case, the steam discharging member 120 may be disposed on one side of the accommodating space to move upward and downward and spray steam or compressed air to the clothing.

The drying function is to remove moisture remaining in the clothing by introducing high-temperature air in the accommodating space using the air circulation device 160.

In addition, the dust removing function is a function to remove dust on the clothing by spraying high-pressure air by a spraying device connected to the clothing support device disposed on the upper end of the accommodating space.

A function used by the clothing management apparatus 100 for performing a clothing management operation is not limited to heating/steaming/drying/dust removing functions, and a method for performing the above functions is not limited to the example.

In illustrating and describing FIG. 3, it has been illustrated and described that one steam generator, steam discharging member, and air circulation device are provided, but in implementation, a plurality of steam generators, a plurality of steam discharging members, and a plurality of air circulation devices may be provided.

In illustrating and describing FIG. 3, it has been illustrated and described that a clothing support device has a shape of an ordinary hanger, but in implementation, the shape is not limited thereto and any shape capable of supporting clothing would be sufficient.

Figure 4:
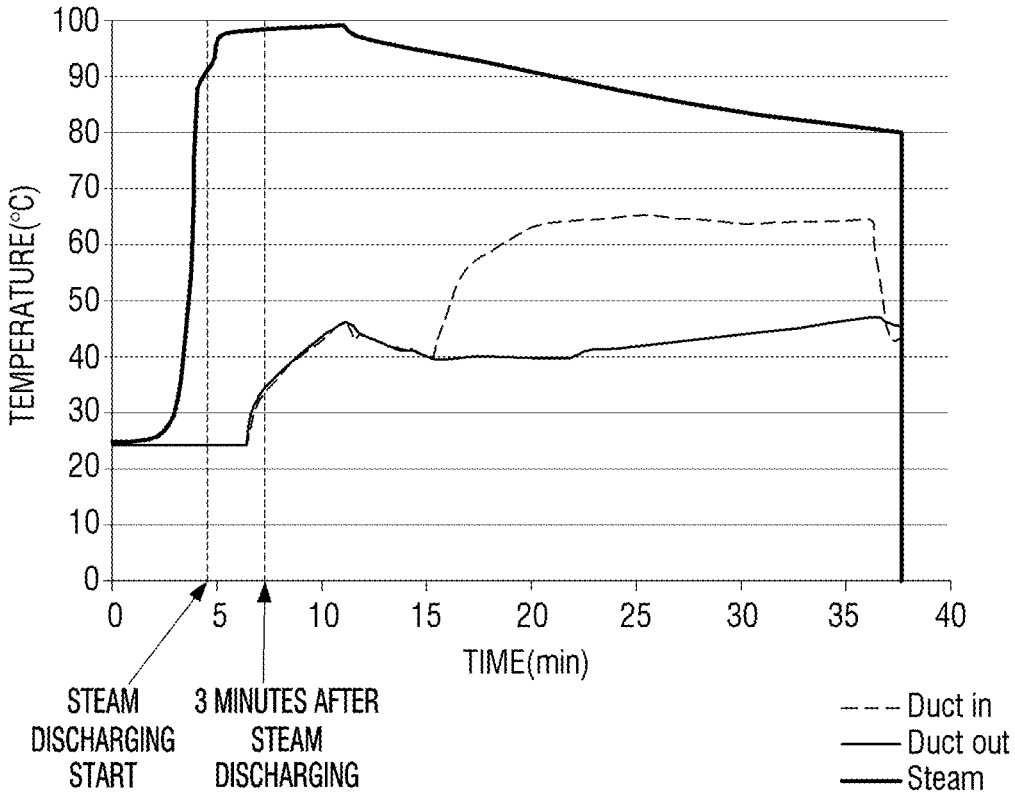
FIG. 4 illustrates a view illustrating an example of temperature sensed after the steam is discharged.

FIG. 4 is a view illustrating an example of temperature sensed after the steam is discharged.

Referring to FIG. 4, temperature of steam itself, temperature sensed at the inlet of the air circulation device 160 (duct out), and temperature sensed at the outlet of the air circulation device 160 (duct in) may be identified.

Temperature of the steam itself may be sensed through a separate temperature sensor provided in the steam generator 110, and the duct out and duct in values may be sensed through the temperature sensor 140 disposed in the air circulation device 160.

The steam discharging member 120 may discharge steam, and the processor 150 may identify the connection state of the steam hose 130 by using temperature information sensed at the timing from when the steam discharging member 120 starts to discharge steam.

Here, the discharge start timing of the steam may be set to the time when the steam discharging member 120 actually performs an operation for discharging the steam. Alternatively, the timing may be set to the timing when temperature of steam generated by the steam generator 110 starts to have a specific temperature. Specifically, the steam may be set to be discharged when the temperature of the steam itself starts to have a temperature of 90 degrees. The method of setting the time point at which steam is started to be discharged is not limited to the above-described example.

For convenience of description, it will be assumed that the start timing to discharge steam is the time when the temperature of steam itself has temperature of 90 degrees.

For example, referring to FIG. 4, it may be identified that the steam discharge started from about four minutes 30 seconds corresponding to the temperature of the steam which is 90° C. The processor 150 may check the connection state of the steam hose 130 by using the temperature information detected by the temperature sensor 140 after about four minutes and 30 seconds.

The processor 150 may identify the connection state of the steam hose 130 using temperature information after a predetermined time has elapsed from the time when the steam is started to be generated.

Specifically, when an operation command for a specific clothing management course of the clothing management apparatus 100 is input, the processor 150 may make an operation of a fan of the air circulation device 160 in a standby status for a predetermined time after the steam discharging member 120 begins spraying steam. If the operation of the fan of the air circulation device 160 is performed at the same time as the spraying of the steam, it may happen that the steam discharged from the steam discharging member 120 is not sufficiently applied to the clothing due to the air circulation.

Therefore, in the standby state of the fan of the air circulation device 160, air circulation is not performed, and when the temperature sensor 140 is disposed in the air circulation device 160 positioned at a lower end of the accommodating space, temperature rise due to steam discharge may not be sensed immediately.

Accordingly, when a predetermined time has elapsed after the steam has started to be discharged, the processor 150 may identify the connection state of the steam hose 130 using the temperature information after the timing when the operation of the fan of the air circulation device 160 begins, and the temperature rise due to steam discharge may be substantially sensed.

For example, referring to FIG. 4, it may be identified that the temperature of duct out and duct in starts to increase according to the operation of the fan of the air circulation device 160 from about two minutes after the start of steam discharging. Therefore, the processor 150 may identify the connection state of the steam hose 130 using the temperature information about six minutes and 30 seconds later, which is about two minutes after the steam discharging start time (four minutes and 30 seconds).

The processor 150 may identify the connection state of the steam hose 130 using only the temperature information detected for a predetermined time from the time when the steam is discharged. Specifically, the processor 150 may identify the connection state of the steam hose 130 using only the temperature information detected during the time generally required for the steam to leak into the internal circuit or the electrical components.

Here, the time which is generally required for steam to be leaked into the internal circuit or electrical components may be set through a repetitive experiment. For example, the required time may be within seven minutes, in general. The required time is not limited thereto.

For example, referring to FIG. 4, if it is assumed that it is generally seven minutes for the steam to leak into the internal circuit or the electrical components, the processor 150 may identify the connection state of the steam hose 130 using only the temperature information sensed from the steam discharge start time (4 minutes and 30 seconds) to about seven minutes later, that is, about 11 minutes and 30 seconds.

In another example, to further prevent damage due to steam leakage, the processor 150 may check the connection state of the steam hose 130 by the temperature information sensed during a time shorter than the time generally required for the steam to leak into the internal circuit or the electrical components. In this case, referring to FIG. 4, the processor 150 may identify the connection state of the steam hose 130 by using temperature information detected until about seven minutes and 30 seconds, which is about three minutes later from the steam discharge start time (four minutes and 30 seconds).

As such, the processor 150 may obtain detected temperature information, calculate a difference of highest temperature and lowest temperature from the temperature information, and identify whether the calculated temperature difference is beyond a predetermined scope.

Specifically, when the calculated temperature difference satisfies a predetermined range, the processor 150 may identify that the steam hose 130 is normally mounted. In contrast, when the calculated temperature difference is out of a predetermined range, the processor 150 may identify that the steam hose 130 is disconnected.

For example, referring to FIG. 4, when the processor 150 identifies the connection state of the steam hose 130 using only the temperature information sensed from the steam discharge start time (four minutes and 30 seconds) to three minutes later, that is, about seven minutes and 30 seconds, the lowest temperature is about 23.9 degrees Celsius and the highest temperature is about 34.7 degrees Celsius, and it may be identified that the temperature difference is about 9.8 degrees Celsius. At this time, if a predetermined range is set to be three degrees Celsius or higher, the processor 150 may identify that the steam hose 130 is mounted normally.

When it is identified that the steam hose 130 is normally mounted, the processor 150 may control so that a clothing management operation is normally performed. In contrast, when it is identified that the steam hose 130 is disconnected, the processor 150 may control so that the steam generation operation of the steam generator 110 is stopped. The processor 150 may perform the clothing management operation by a remaining course other than the steam generation operation.

Referring to FIG. 4, it may be identified that the temperatures of duct in and duct out have different values after about 15 minutes. This is attributable to discharge of high-temperature air from the air circulation device 160, as the compressor of the air circulation device 160 starts an operation.

However, the temperature information necessary to identify the connection state of the steam hose 130 corresponds to the temperature information before the compressor starts operation of the air circulation device 160 and thus, the processor 150 may identify the connection state of the steam hose 130 using any one of temperature information detected by the temperature sensor 140 disposed at the inlet and the outlet of the air circulation device 160.

Figure 5:
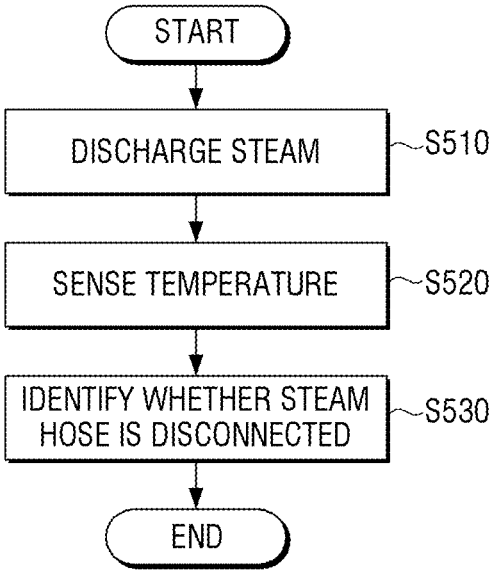
FIG. 5 illustrates a flowchart to describe a controlling method of a clothing management apparatus according to an embodiment.

FIG. 5 is a flowchart describing a controlling method of a clothing management apparatus according to an embodiment.

Steam is generated first and then the generated steam is discharged to clothing through the steam hose in step S510. To be specific, when a control command including the steam function is input from the user, steam may be generated and the generated steam may be discharged to the clothing through the steam hose to change the fabric construction of the clothing to a flexible state.

Then, the temperature in the clothing management apparatus is sensed in step S520. To be specific, after the steam is generated and steam is discharged, the temperature information sensed in the clothing management apparatus may be obtained through the temperature sensor. More specifically, after the steam is generated and steam is discharged, the temperature information sensed during a predetermined time may be obtained through the temperature sensor.

Here, the predetermined time may be time generally required for the steam to leak into the internal circuit or the electrical component. In order to further prevent damage to the clothing management apparatus, the predetermined time may be shorter than the time normally required for steam to leak into the internal circuit or the electrical component.

Based on the sensed temperature, the connection state of the steam hose is identified in step S530. To be specific, whether the temperature changing width sensed by the temperature sensor after the steam is discharged satisfies a predetermined range, the connection state of the steam hose may be identified.

Here, the predetermined range may refer to the range of average changing variation of sensed temperature, when the steam hose is normally mounted, and this may be determined according to a repetitive experiment result. For example, the predetermined range may be three degrees Celsius or higher.

More specifically, it is possible to calculate the difference between the highest temperature and the lowest temperature of the detected temperature information and determine whether the calculated temperature difference is out of the predetermined range. When the calculated temperature difference satisfies the predetermined range, it may be identified that the steam hose is normally installed, and when the calculated temperature difference is out of the predetermined range, it may be identified that the steam hose is disconnected.

Therefore, the controlling method of the clothing management apparatus of the disclosure may determine whether the hose is disconnected by using the temperature sensor without an additional sensor that can detect whether the steam hose is disconnected. Therefore, by grasping the steam leakage due to steam hose disconnection, damage to the clothing management apparatus may be prevented and an additional sensor is not required, and thus, there is the effect of saving costs. The controlling method as shown in FIG. 5 may be executed by the clothing management apparatus having the configuration of FIG. 2, or by any other clothing management apparatus having another configuration.

In addition, the controlling method as described above may be implemented as at least one execution program for executing the controlling method as described above, and the execution program may be stored in a non-transitory computer readable medium.

Non-transitory readable medium means a medium that stores data for a short period of time such as a register, a cache, and a memory, but semi-permanently stores data and is readable by the apparatus. In particular, the various applications or programs described above may be stored and provided on non-volatile readable media such as CD, DVD, hard disk, Blu-ray disk, USB, memory card, ROM.

Figure 6:
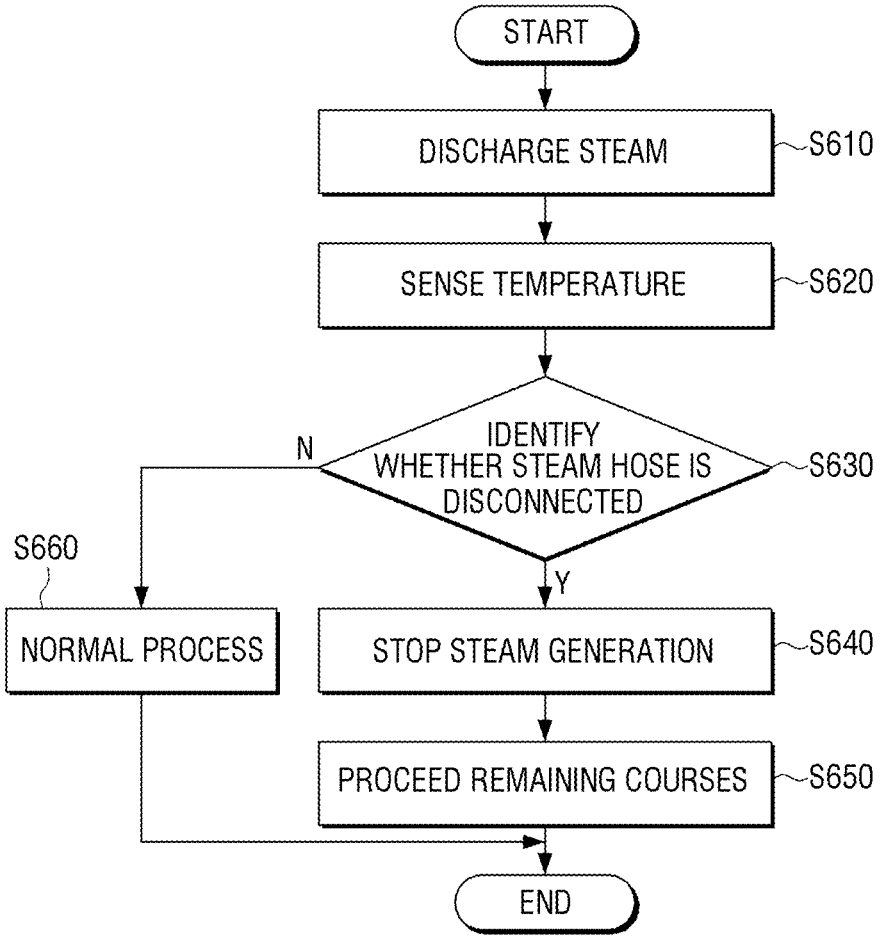
FIG. 6 illustrates a flowchart to describe a specific controlling method of a clothing management apparatus according to an embodiment.

FIG. 6 is a flowchart describing a specific controlling method of a clothing management apparatus according to an embodiment.

First, steam may be generated, and the generated steam may be discharged to the clothing through the steam hose in step S610. It is possible to detect the temperature in the clothing management apparatus in step S620. The connection state of the steam hose may be identified based on the sensed temperature in step S630.

The step S610 to S630 are the same as S510 to S530 of FIG. 5, the duplicate description will be omitted.

If disconnection of the steam hose is identified in step S630-Y, the steam generation operation may be stopped in step S640. The clothing management operation may be performed with a remaining course other than the steam generation operation in step S650.

Specifically, the clothing management apparatus is capable of performing a plurality of functions such as heating/steaming/drying/dust removing, or the like, and if it is identified that the steam hose is disconnected, the apparatus may be controlled to perform heating, drying, dust removing function except steam function.

Through the display, the error information on the steam hose disconnection may be displayed to a user through the display. In addition, through the communicator, information on the steam hose disconnection may be provided to a management server corresponding to a service center.

When it is identified that the steam hose is not disconnected in step S630-N, it is possible to perform the clothing management operation normally in step S660. Specifically, when it is identified that the steam hose is not disconnected, the clothing management operation including the steam function may be performed as the existing plan.

Although the present disclosure has been described with various embodiments, various changes and modifications may be suggested to one skilled in the art. It is intended that the present disclosure encompass such changes and modifications as fall within the scope of the appended claims.

What is claimed is:

1. A clothing management apparatus comprising:

a steam generator configured to generate steam;

a steam discharging member comprising a spraying head configured to receive steam generated by the steam generator through a hose and discharge the received steam to clothing disposed in an accommodating space within the clothing management apparatus;

a temperature sensor configured to sense a temperature in the clothing management apparatus;

a display;

a communicator;

an air circulation device comprising a fan and a heater, the air circulation device being disposed in a lower portion of the accommodating space;

a clothing support device disposed on an upper end of the accommodating space;

a spraying device connected to the clothing support device; and a processor configured to:

control an operation of the steam generator and steam discharging member to perform a steam generation course, after the steam generation course begins, control an operation of the air circulation device to perform an air circulation for discharging heated air on the clothing, and identify that the hose is disconnected based on a range of the temperature sensed by the temperature sensor in the air circulation device being less than a predetermined range threshold during a predetermined time during the operation of the air circulation device, wherein the processor is further configured, based on the hose being identified as disconnected, to:

stop the steam generation course, control the display to display error information, control the communicator to send the error information to a management server corresponding to a service center, and perform a clothing management operation with a remaining course, wherein the clothing management operation includes a heating function, a drying function, and a dust removing function, wherein the heating function is a function to discharge heated air into the accommodating space by using the air circulation device for changing a fabric structure of the clothing into a flexible state, wherein the drying function is a function to discharge heated air into the accommodating space by using the air circulation device for removing moisture remaining in the clothing, and wherein the dust removing function is a function to spray pressured air into the accommodating space by using the spraying device for removing dust on the clothing.

* * * * *